United States Patent [19]

Sullivan

[11] Patent Number: 4,986,087

[45] Date of Patent: Jan. 22, 1991

[54] FAN COIL UNIT

[76] Inventor: John T. Sullivan, 3910 Madison St., Hyattsville, Md. 20781

[21] Appl. No.: 444,267

[22] Filed: Dec. 1, 1989

[51] Int. Cl.[5] ..... F25D 21/14

[52] U.S. Cl. ..... 62/291; 165/122

[58] Field of Search ..... 62/285, 286, 288, 291; 165/122; 220/1 C, DIG. 6

[56] References Cited

U.S. PATENT DOCUMENTS

| | | | |
|---|---|---|---|
| 2,059,086 | 10/1936 | Campbell | 62/285 X |
| 2,899,803 | 8/1959 | Paley | 62/291 |
| 3,050,958 | 8/1962 | Allender | 62/285 |
| 3,491,550 | 1/1970 | Cavis | 62/285 |
| 3,997,074 | 12/1976 | Shead | 220/71 |
| 4,507,940 | 4/1985 | Sato et al. | 165/122 X |
| 4,597,269 | 7/1986 | Kim | 62/286 |

*Primary Examiner*—William E. Tapolcai

*Attorney, Agent, or Firm*—Diller, Ramik & Wight

[57] ABSTRACT

A fan coil unit includes a coil supported above a primary pan defining therebetween a gap which is closed by a thin flexible water impermeable bellows which prevents air from a fan from being blown through the gap and instead directs the air through the coil. The primary pan is in situ molded with rods therein for reinforcement and also includes upstanding motor mounts which prevent faster corrosion.

35 Claims, 5 Drawing Sheets

16
4
4
32
58
56
42
33
34
32
47
41
39
38
36
46
43
45
35
40
48
20
100
65
12
106
103
52
13
92
102
100
3
3
102
69
103
20
54
13
12
106
65
49
50
100
35
40
43
41
39
37
36
34
31
47
42
57
31
59
44
33

13'
145
144
56'
58'

13
6
54
72
74
64
61
58
67
56
45
39
40
62
69
101
100
80
71
53
73
52
55
66
57
59
44

75
76
89
84
82
81
65
83

FAN COIL UNIT

CROSS-REFERENCE TO RELATED APPLICATIONS

This invention is directed to a fan coil unit for commercial and residential air conditioners which can utilize a primary pan or convector tray of the type disclosed in application Ser. No. 251,602 filed on Sept. 30, 1988 and granted Letters Patent on Aug. 15, 1989 under U.S. Pat. No. 4,856,672 in the name of John Sullivan.

BACKGROUND OF THE INVENTION

Residential and commercial air conditioners include as a part thereof a fan coil unit. The fan coil unit includes a coil through which coolant (liquid or gas) is pumped, and normally the coil is supported above a condensation pan or convector tray having one or more openings through which air is blown by one or more fans powered by motors which are supported below and from the condensation pan. The air passing through the coil creates condensation on the coil which drips down upon the condensation pan or primary pan, and is then conducted by an appropriate outlet and a discharge pipe to a secondary pan and therefrom to a drain.

Such conventional convector trays or primary pans are generally made from galvanized metal and rust with relative ease. Once the convector tray rusts the water might, for example, drip down into the underlying motor(s) which drives the fan(s), causing the motor to short-out. Excessive rust also blocks or reduces normal drainage which results in fungus growth which in turn can cause odors and also can cause the normal drain opening to close or appreciably block with, of course, attendant overflow and damage.

The latter-identified patent reduces rust and fungus growth associated with conventional galvanized metal primary pans. However, it has also been found that sponge rubber seals or rubber gaskets associated with such conventional primary pans and condensation coils also deteriorate and virtually break-down into "dust" or extremely small particles which block or reduce drainage of condensation from the pans. This same deteriorated rubber/particles also results in fungus growth which in turn can also cause the heretofore noted undesirable odors. Furthermore, when such rubber gaskets deteriorate and disintegrate, a gap is formed between the bottom of the condensation coil and the primary pan through which air which is normally forced through the condensation coil flows through this gap. Since the air which passes through the gap does not pass through the condensation coil, the efficiency of the overall unit is appreciably diminished. Furthermore, condensation which collects in the primary pan also attacks conventional metallic fasteners which secure the motor housing to the bottom of the primary pan with the result that the motors can actually tear loose from the pan. However, even if this does not occur, water can drip through the fastener openings in the primary pan as the fasteners and the periphery of the metal surrounding the openings corrodes, and such leakage can enter the electric motor resulting in the shorting and permanent damage thereof.

SUMMARY OF THE INVENTION

The present invention is directed to a novel fan coil unit which overcomes the disadvantages heretofore noted by providing a primary pan constructed from a single piece of in situ molded polymeric/copolymeric material from which a fan motor is supported while a peripheral wall of the primary pan defines a gap with a lower edge portion of an associated condensation-/evaporation coil. In keeping with this invention, this gap is at all times maintained closed by a thin flexible water impermeable flaccid bridging element in the form of a folded and/or fan-folded sheet which preferably is formed as a bellows. Accordingly, irrespective of the gap between the primary coil and bottom portion of the coil, the folded, fan-folded or bellows-like sheet will accommodate itself to whatever might be the size of the gap as well as the inclination of the primary pan relative to the coil. In most installations the primary pan is tilted a few degrees one way or the other depending upon the location of the main drain pipe of the residential or commercial establishment. The coil is, of course, supported with its bottom edge essentially horizontal. Thus, if the primary pan is tilted to convey condensation collected therein from left-to-right, the gap between the primary pan and the coil is less at the left-hand end than at the right-hand end. Similarly, if the primary pan is tilted to drain from right-to-left, the gap between the primary pan and the coil is less at the right than at the left. However, irrespective of the size of the gap or the installation and/or tilt of the primary pan, the gap will be at all times bridged by the bellows of the present invention. The latter assures that all air blown through the openings of the primary pan toward the coil will pass through the coil thereby increasing the efficiency thereof. Moreover, all the condensation formed on the coil will be confined onto the primary pan and will drain therefrom.

The invention also provides novel motor mounts which are formed as integral in situ molded portions of the primary tray. The motor mounts are elevated relative to an inner surface of a bottom wall of the primary tray, and thus condensation cannot attack fasteners housed in bores of the motor mounts, particularly because silicone or like material closes the bores after the fasteners have been secured to the motor housing.

In further accordance with the present invention, the primary tray also includes transverse edges which have rounded bottoms to permit the primary tray to be slidingly connected to an associated housing and to also permit the tray to be readily tilted for left-to-right or right-to-left drainage. Also, at least one longitudinal edge, though preferably both longitudinal edges, is provided with a metal reinforcing rod which is bonded thereto and/or in situ molded during the molding of the primary pan.

A final aspect of the invention is the provision of novel clips for securing the bellows to one or both of the coil or the inside of the primary tray by a simple snap-action. This avoids nuts and bolts or screws, the loss thereof, and the time consuming effort involved in assembly and disassembly.

With the above and other objects in view that will hereinafter appear, the nature of the invention will be more clearly understood by reference to the following detailed description, the appended claims, and the several views illustrated in the accompanying drawings.

DESCRIPTION OF THE PREFERRED EMBODIMENT

Figure 1:
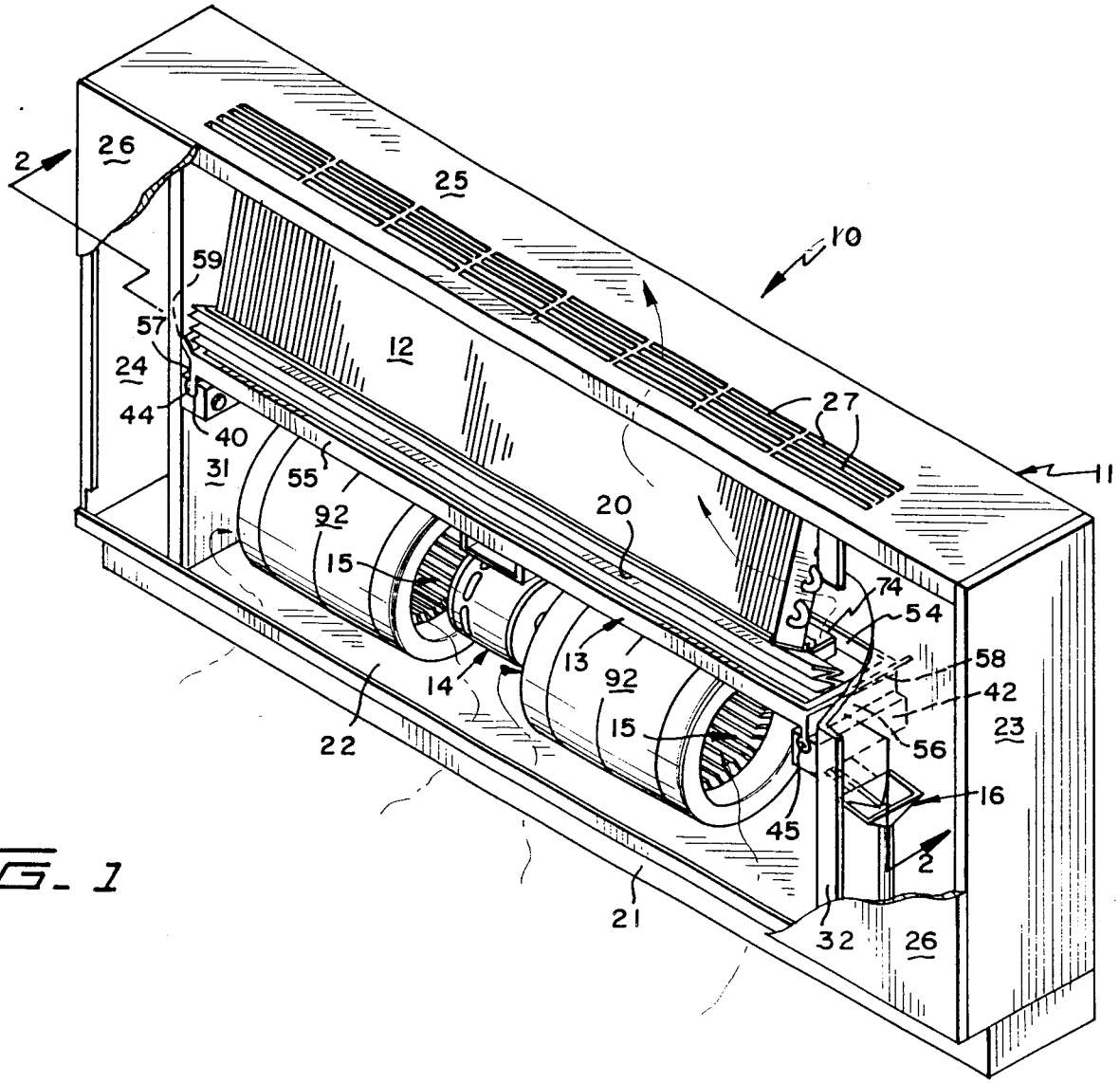
FIG. 1 is a fragmentary perspective view of a novel fan coil unit of the invention, and illustrates a coil supported above a primary tray, a bellows bridging a gap between the coil and the primary tray, and a pair of fans driven by a motor carried by the primary tray or pan.

A novel fan coil unit is illustrated in FIG. 1 of the drawings, and is generally designated by the reference numeral 10. The fan coil unit 10 includes a housing 11, a condensation/ evaporation coil 12, a primary pan or convector tray 13, a motor 14 for rotating fans 15, a secondary pan 16 and means 20 in the form of a thin flexible bellows bridging a gap (unnumbered) between the coil 12 and the primary pan 13.

The housing 11 includes a base 21 disposed in a generally horizontal plane and provided with a plurality of openings (not shown) covered by a filter 22. The housing 11 also includes opposite sides 23, 24 and a top 25 which can be appropriately flanged for rigidity and secured to each other, to the base 21, and to a front panel 26. A plurality of air ducts or openings 27 are formed in the top or top panel 25. Two generally vertical upstanding parallel angle irons or supports 31, 32 are connected to the base 21 and the top 25. The front panel 26 is secured by sheet metal screws or the like to various ones of the walls or panels, particularly the flanges (unnumbered) thereof to permit the front panel 26 to be quickly removed to gain access to the interior of the housing 11 for servicing and/or repair.

Figure 2:
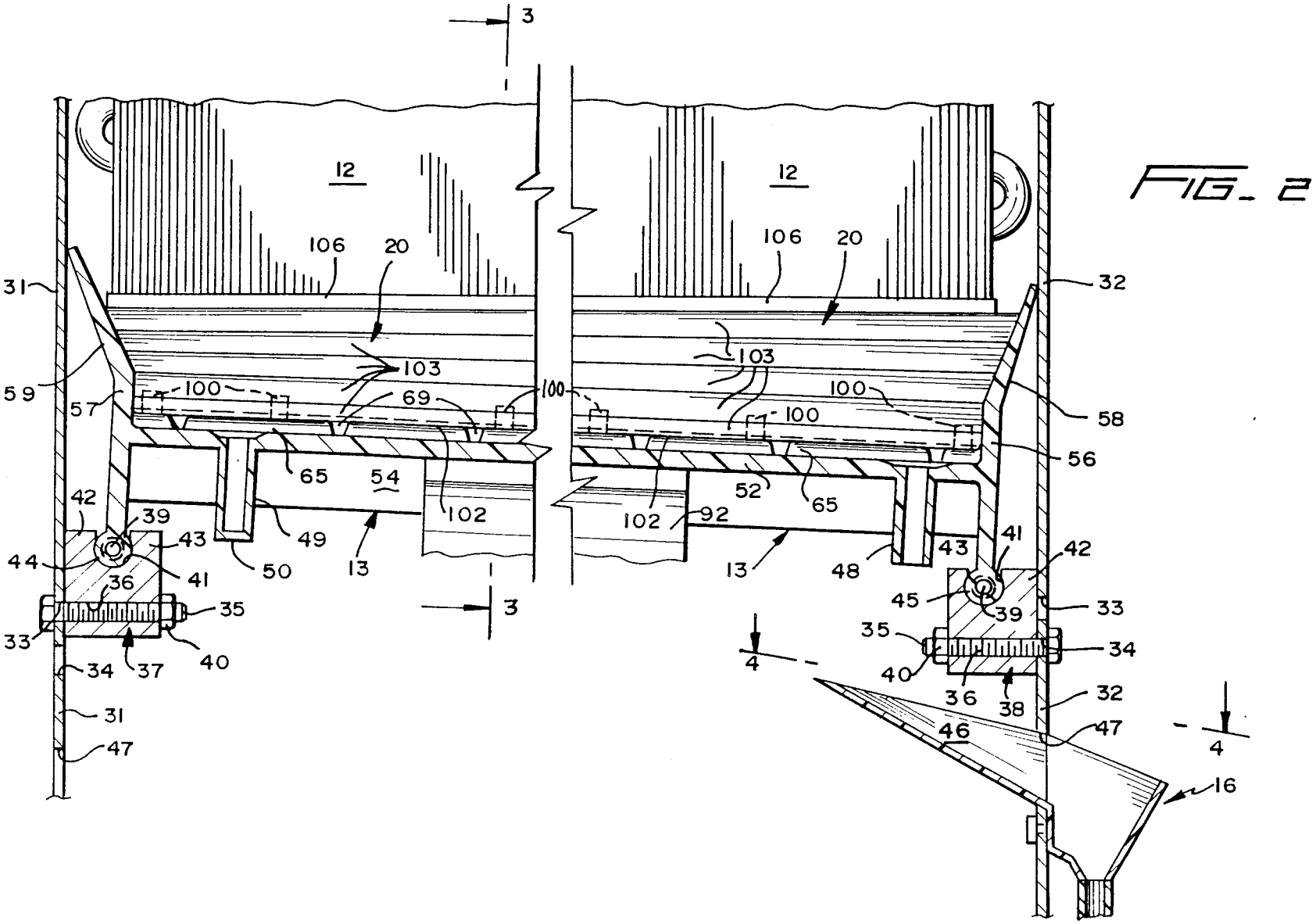
FIG. 2 is an enlarged fragmentary cross sectional view taken generally along line 2—2 of FIG. 1, and illustrates the primary pan tilted for left-to-right drainage, and the manner in which the bellows closes the gap between the primary pan and a lower portion of the coil.

The supports 31, 32 each have vertically aligned circular bores or openings 33, 34 (FIG. 2). The bores 33, 33 of the supports 31, 32 are in horizontal alignment, as are the bores 34, 34. Bolts 35 pass through bores 36 of guide and support blocks 37, 38 (FIG. 2) and are secured thereto by nuts 40. The guide and support blocks 37, 38 each includes an upwardly opening slot 41 defined by upwardly projecting legs 42, 43. Each slot 41 is generally semi-circular in transverse cross section, as is best illustrated in FIG. 2 and extends slightly beyond 180#. The slots 41 each receive a rounded generally cylindrical terminal lower edge 44, 45 of the primary pan 13 which permits the primary pan 13 to be slid into and slid from the front of the housing 11 once the front panel 26 is removed, as is most readily apparent from FIG. 1. Furthermore, the rounded nature of the terminal edges 44, 45 permits the primary tray 13 to be readily pivoted or tilted relative to the slots 41 when the primary pan 13 is selectively utilized for either right-to-left or left-to-right draining.

Figures 5, 6, 7:
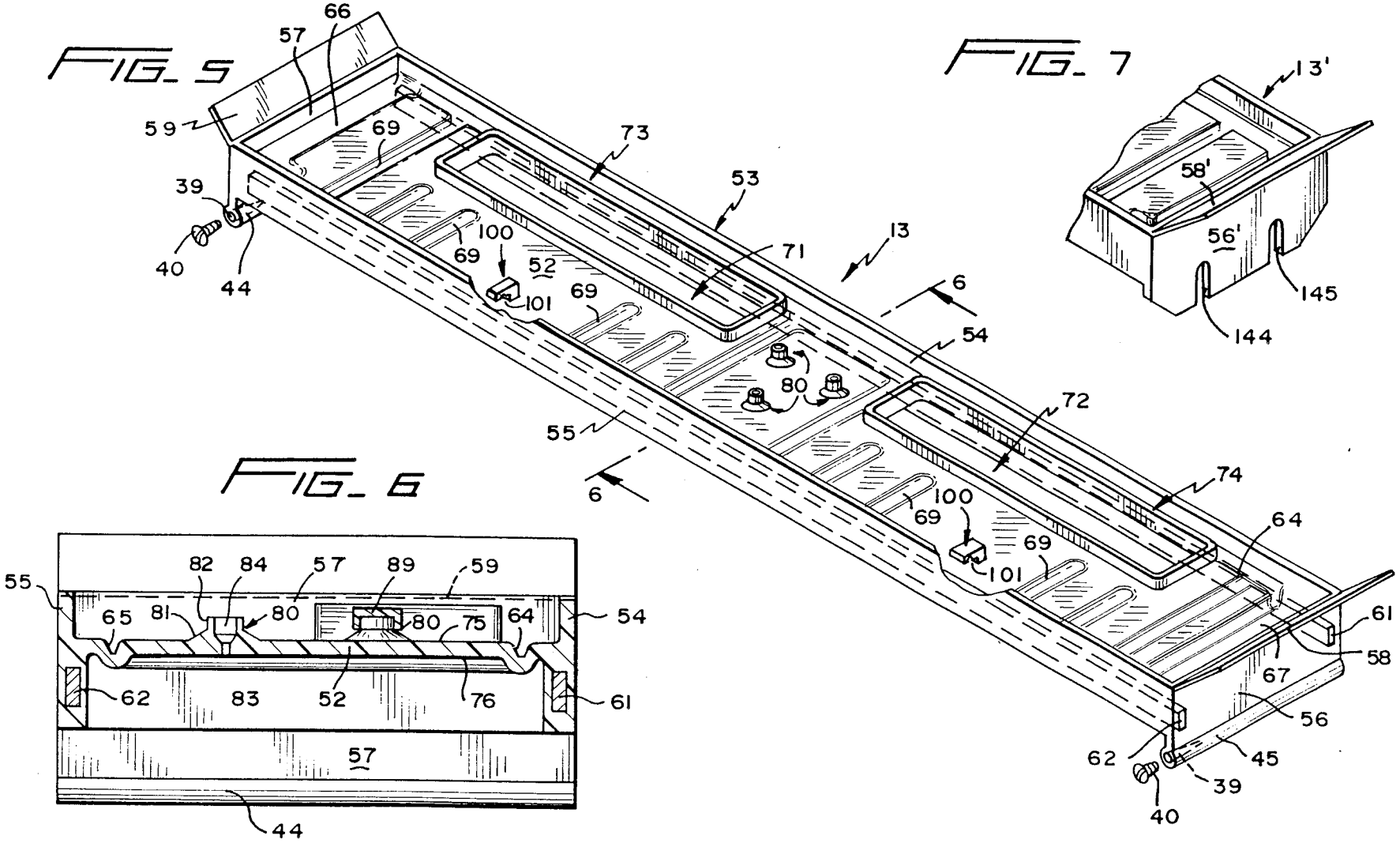
FIG. 5 is a top perspective view of a novel primary pan or convection tray of the invention, and illustrates a pair of metallic longitudinal reinforcing rods encapsulated in the primary pan during the in situ molding thereof, integral motor mounts upstanding from a bottom wall of the pan, and transverse end walls of the pan having rounded lower edges and upper edge sealing flaps.
FIG. 6 is an enlarged cross sectional view taken generally along lines 6—6 of FIG. 5 and illustrates details of the motor mounts and the metallic reinforcing rods or bars.
FIG. 7 is a fragmentary perspective view of a transverse end wall of another primary pan, and illustrates the wall having a pair of slots for adjusting the primary pan for left-to-right or right-to-left drainage.

The front ends (unnumbered) of the lower edges 44, 45 which are accessible from the front of the housing 11, as is apparent from FIG. 1, are provided with tapered threaded bores 39 (FIG. 5). When the primary pan 13 is positioned as required with the lower edges 44, 45 housed in the slots 41, threaded fasteners or screws 40 which have threaded portions (unnumbered) larger than the threaded bores 39 are threaded into the threaded bores 39 to progressively expand the same which in turn expands the front end portions (unnumbered) of the lower edges 44, 45 radially outwardly bringing the same into frictional purchase with the legs 42, 43 of the blocks 37, 38. In this fashion, the primary pan 13 is firmly locked in its position and cannot slide forwardly or rearwardly due to, for example, vibration. Furthermore, since the slots 41 converge from front to rear, as viewed in FIG. 1, the inward sliding of the lower edges 44, 45 progressively tighten within the slots 41. If, however, the lower edges 44, 45 are not firmly "jammed" home into the tapered slots 41, the primary pan 13 might vibrate and shift forwardly. However, this is precluded by the aforementioned tightening of the fasteners 40 and the radially outward expansion of the lower edge portions 44, 45 into frictional gripping engagement with the legs 42, 43 of the guide blocks 37, 38.

In FIG. 2 the primary pan 13 drains from left-to-right toward the secondary pan 16 which has a gutter portion or lip 46 which projects through an opening 47 of the support 32 and is in vertical alignment with a normally closed discharge pipe or spout 48 of the primary pan 13. The discharge pipe or spout 48 is one of two discharge pipes or spouts 48, 49 projecting downwardly from the bottom wall 52 with each being of a tubular configuration and normally closed by a wall 50. The tubular drain spout 48 is shown with a severed lower edge (unnumbered) cut by a knife or like to remove the wall 50 therefrom so that condensation can appropriately drain therethrough. If, however, the primary pan 13 was mounted for right-to-left drainage, the block 38 would be elevated and supported by the bolt 35 passing through the bore or opening 33 of the support 32 whereas the block 37 would be lowered and supported by the bolt 35 passing through the lower bore or opening 34 of the support 31. In this case the discharge pipe or spout 48 would retain its end wall 50 but the end wall 50 of the spout 49 would be removed and, of course, the secondary pan 16 would be located with its gutter portion or lip 47 projecting through the opening 47 of the support 31. Thus, irrespective of the direction of drainage or the tilting direction of the primary pan 13, the rounded exterior configuration of the terminal edges 44, 45 and the corresponding rounded configuration of the slots 41 allow tilting of the primary pan 13 and, of course, the sliding insertion, removal and reinsertion thereof heretofore noted.

Reference is now made to FIGS. 5 and 6 of the drawings which illustrates the primary pan or convector tray 13. The specific details of the primary pan 13 are disclosed in the latter-noted patent, and the entirety thereof which is compatible herewith is incorporated herein by reference.

The primary pan or condensation pan 13 includes a relatively elongated pan body 51 constructed from in situ vacuum molded polymeric/copolymeric material, such as glass filled fire retardant polypropylene or fire retardant ABS. The latter materials eliminate rust build-up and reduce drain and condensate passage/channel clogging due to mineral deposits, deterioration and fungus growth.

The pan body 51 includes a generally rectangular bottom wall 52 and an upstanding peripheral wall 53. The upstanding peripheral wall 53 includes generally parallel longitudinal walls 54, 55 and generally parallel end walls 56, 57 terminating at their bottoms at the respective rounded lower terminal edges 45, 44, and at their tops in endwise projecting thin flexible sealing flaps 58, 59. A metallic reinforcing strip 61, 62 is fully encapsulated within the respective longitudinal walls 54, 55 by the in situ molding heretofore described. In other words, the metallic strips 61, 62 are positioned in an appropriate injection mold (not shown) after which the polymeric material is charged/ injected into the mold cavity resulting in the in situ bonded encapsulation of the reinforcing strips 61, 62 within the respective longitudinal walls 54, 55, as is best illustrated in FIG. 6.

In keeping with another aspect of the invention, the walls 54, 55 can be molded with rectangular longitudinal bores therein during the molding operation and the reinforcing strips 61, 62 can be slid in and bonded by gluing to these bores or grooves. Alternatively, the strips 61, 62 can be bonded to the inside or outside surfaces of the walls 54, 55. In any event, the reinforcing strips or members 61, 62 are preferably constructed from aluminum or like relatively non-corroding metallic material to eliminate/reduce corrosion and fungus growth.

A pair of generally parallel longitudinal drain channels 64, 65 are formed in the bottom wall 52 and these merge at opposite ends with relatively large drain recesses 66, 67. Transverse drains or channels 69 conduct condensate from the bottom wall 52 to the drain channels 64 and/or 65, to the recesses 66, 67 and to either of the spouts 48, 49. A pair of elongated generally rectangular openings 71, 72 are formed in the bottom wall 52 and are respectively bounded by upstanding peripheral walls 73, 74 which prevent condensate from flowing downwardly through the openings 71, 72.

Figure 3:
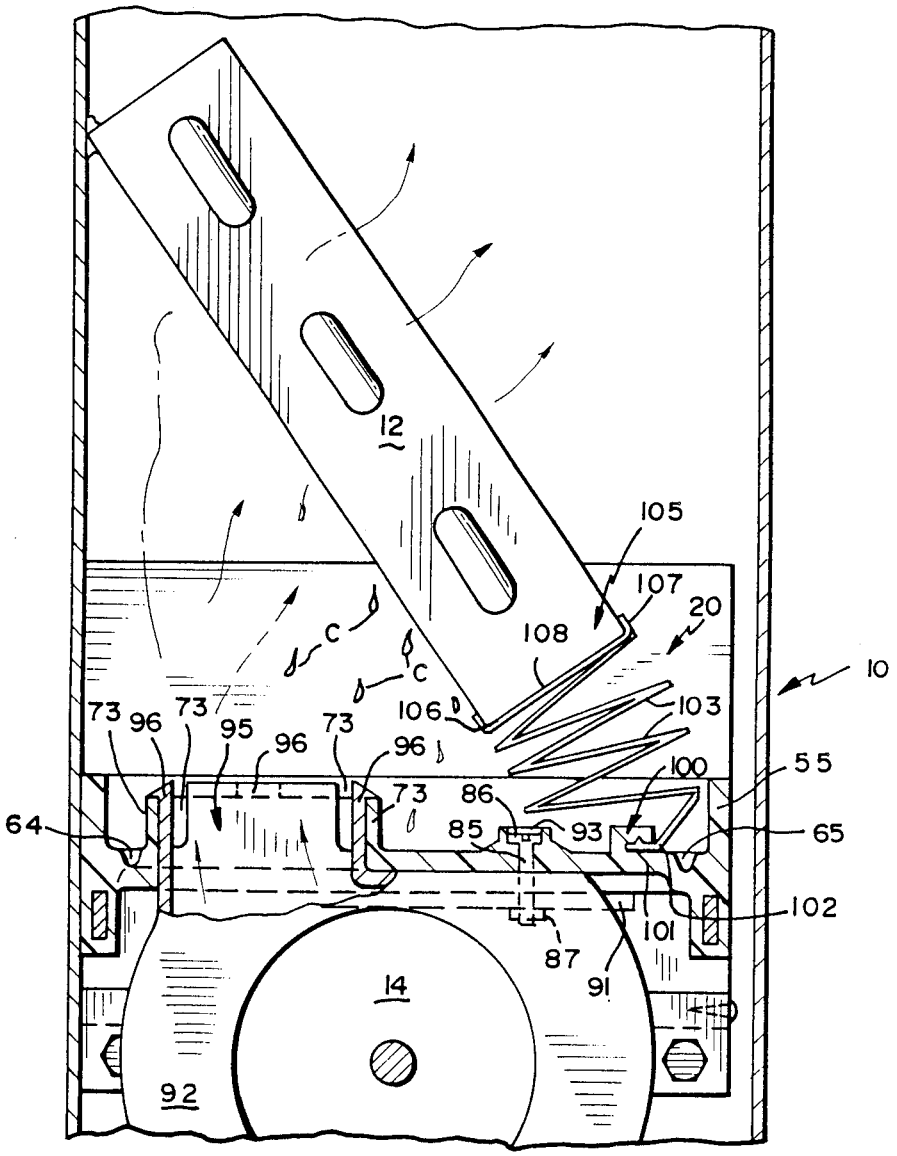
FIG. 3 is a cross sectional view taken generally along line 3—3 of FIG. 2, and illustrates the manner in which housings of a pair of fans and a motor are fastened to an underside of the primary pan, and the location of the bellows spanning the gap between the condensation coil and the primary pan.
Figure 4:
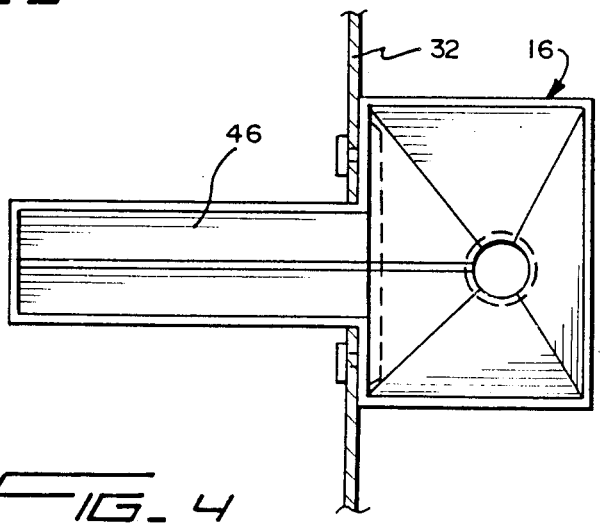
FIG. 4 is a cross sectional view taken generally along line 4—4 of FIG. 2, and illustrates a secondary pan into which condensation from the primary pan drains.

The bottom wall 52 includes an upper surface 75 and a lower surface 76. Three identical motor mounts 80 (FIGS. 5 and 6) project upwardly from the surface 75 generally centrally of the pan body 51 somewhat between the openings 71, 72 and the peripheral walls 73, 74, respectively. Each motor mount 80 is, of course, in situ integrally molded during the injection molding of the primary pan 13. Each motor mount 80 includes a relatively wide frusto-conical base 81 and a cylindrical top 82. Each motor mount 80 also includes a bore 83 and a relatively larger counter bore 84. A bolt 85 (FIG. 3) having a head 86 is appropriately seated in the bore 83 and the counterbore 84, and a nut 87 fastens the bolt 85 to a supporting flange 91 of a motor/fan housing 92 of the motor 14 and the fans 15. Silicone or like gasket material 93 is then injected into the counterbore 84 above the head 86 of each of the bolts 85 to prevent condensation from attacking, corroding and adversely affecting not only each bolt 85, but the underlying support flange 91 of the motor fan housing 92 and the nut 87 associated with each bolt 85. A cap 89 (FIG. 6) can be used instead of the silicone. Obviously, the silicone can also be inserted in the counterbore 84 and the cap 89 placed upon the cylindrical portion 82 of each motor mount 80, although this would in most cases be redundant.

The motor/fan housing 92 also includes two upwardly projecting peripheral connecting walls 95 (FIG. 3) having an exterior peripheral profile complimenting the interior profile of the peripheral walls 73, 74. Each of the connecting walls 95 has a plurality of outwardly directed tongues 96 which can deflect inwardly as the connecting walls 95 are inserted into the openings 71, 72 from below and will, of course, snap into overlying relationship to the upper peripheral edges (unnumbered) of the walls 73, 74 in the manner shown in FIG. 3. Thus, the motor/fan housing 92 suspends the motor 14 and the fans 15, 15 in a relatively stable fashion by virtue of the centrally located fasteners or bolts 85 and the connecting walls 95, 95 located to either side thereof. Furthermore, the broad frusto-conical bases 81 of the motor mounts 80 (FIG. 6) not only assure condensation drainage, but serve as reinforcement to offset the turning moment or torque during the operation of the motor 14.

A plurality of bellows clips 100, only two of which are shown in FIG. 5, are integrally molded in upstanding relationship to the bottom wall 52 adjacent the channel 65 (FIGS. 3 and 5), and each includes a slot 101 opening toward the longitudinal wall 55. The slots 101 are each contoured to the configuration of a lower longitudinal edge portion 102 of the water impermeable fan-folded bellows 20 which includes a plurality of fan-folded portions 103 and an upper generally U-shaped clip portion 105 defined by generally parallel legs 106, 107 and a bight 108. The coil 12 is, of course, suitably connected to the angle irons or supports 31, 32 and the bellows 20 spans the gap (unnumbered) heretofore noted which, in the absence of the bellows 20, exists between the bottom of the condensation/evaporation coil 12 and the primary pan 13. Thus, the bellows 20 fills this gap and assures that air from the fans 15, 15, exiting the peripheral connecting walls 95 of the fan housing 92 is directed to and through the coils (individually unnumbered) of the condensation coil 12, as is indicated by the unnumbered headed arrows in FIGS. 1 and 3. Obviously, the air is created by the energization of the motor 14 and the rotation of the fans 15 resulting in the creation of condensation or droplets C (FIG. 3) which form on the coil 12, drop into the primary pan 13 and are eventually discharged therefrom in the manner heretofore described.

The bellows 20 is, of course, constructed from relatively noncorroding, thin, flexible, water impermeable polymeric/copolymeric plastic material, such as that specifically described heretofore. Materials of this type are virtually indestructible, cannot rust or corrode and thus, essentially eliminate or appreciably lessen fungus growth and drainage clogging. Furthermore, since the material of the bellows 20 is relatively thin, a preselected length can be cut using scissors or shears to accommodate the bellows 12 to the interior size, shape and configuration of an associated housing 11. For example, in FIG. 2 the bellows 12 is shown cut at each lower corner such that the longitudinally extending bottommost portion 102 of the bellows 20 seats within the condensation pan 13 in intimate contact with the walls 56, 57 and the sealing flaps 58, 59. Thus, the air introduced into the area beneath the coil 12 not only cannot escape beneath the coil 12 and the primary pan 13, but air which would otherwise escape at outboard ends of the coil 12 between the coil 12 and each of the supports 31, 32, is precluded from doing so by both the sealing flaps 58, 59 contacting the supports 32, 31, respectively, and the end portions of the bellows 20 sealing against the flaps 58, 59 (See FIG. 2). Furthermore, due to the flexible nature of the bellows 20 and the fan-fold portions 103 thereof, the bellows 20 readily accommodates to the size and configuration of the gap between the bottom of the coil 12 and the primary pan 13, as is most readily apparent from FIG. 2. In FIG. 2 the fan folds 103 are closer together or more "closed" at the left-hand end of the primary pan 13 and the coil 12 than the more "open" fan folds 103 at the right-hand end thereof, the latter occurring because of the left-to-right drainage inclination of the primary pan 13 heretofore described.

In keeping with another aspect of the present invention, another primary pan 13' is shown in FIG. 7 and the structure thereof corresponds identically to that of the primary pan 13. However, opposite transverse or ends walls, of which only one is shown and is designated by the reference numeral 56', excludes the rounded terminal ends 44, 45 and instead is provided with downwardly opening generally parallel slots 144, 145. These slots are designed to accommodate pairs of bolts, such as the bolts 35 with the slots 144, 145 permitting appropriate tilting of the primary pan 13'.

Figure 8:
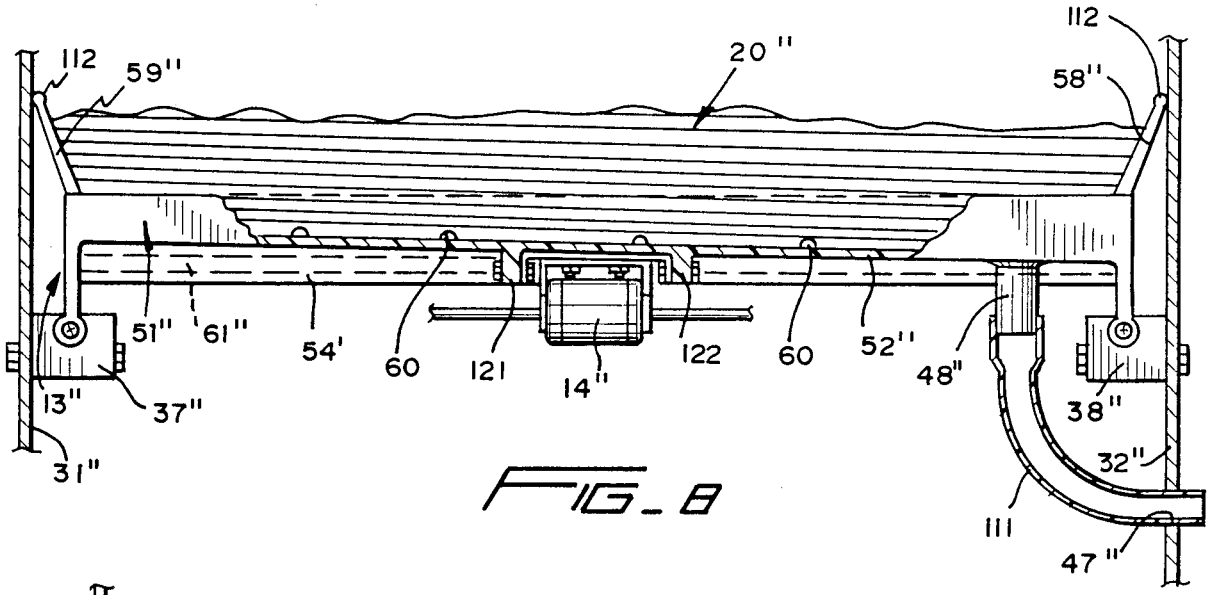
FIG. 8 is a reduced fragmentary cross sectional view similar to FIG. 2, and illustrates another primary pan of the invention "dedicated" for left-to-right drainage and a bottom wall having integral depending motor mounts.
Figure 9:
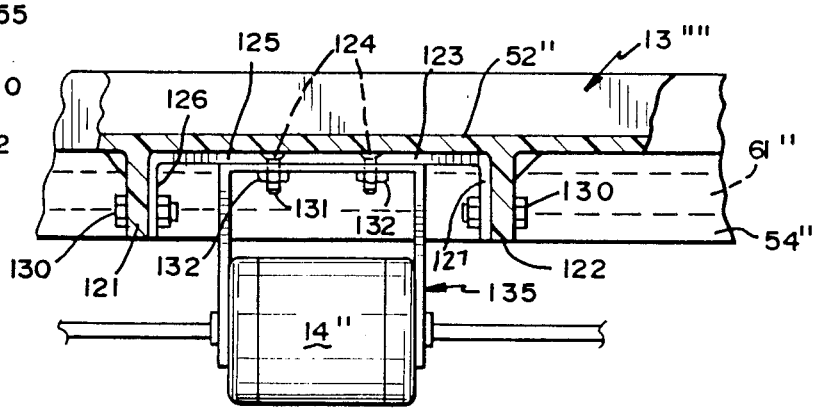
FIG. 9 is an enlarged fragmentary view of the motor mount of FIG. 8, and illustrates a pair of inverted U-shaped brackets securing a motor to a bottom wall of the primary pan.

Reference is made to FIGS. 8 and 9 of the drawings in which elements corresponding to those heretofore described relative to FIGS. 1 through 6 have identical though double primed numerals. In this case, a bottom wall 52'' of a pan body 51'' slants downwardly, as viewed in FIG. 8 from left-to-right, and also pitches forwardly from front-to back toward a single drain spout 48'' connected to a tubular hose 111 which projects toward an opening 47'' of a vertical support 32''. The primary pan 13'' is thereby "dedicated" for use in installations in which the secondary drain (not shown) or an outlet is at the right-hand side of the overall fan coil unit (not shown) or to the right of the wall 32''. Obviously, it is in keeping with the present invention to similarly "dedicate" a primary pan for right-to-left drainage in which case the bottom wall thereof, corresponding to the bottom wall 52'', would be inclined downwardly from right-to-left and also from back-to-front to drain toward an unillustrated spout corresponding to the spout 49.

The primary pan 13'' also includes sealing flaps or lips 58'', 59'' which diverge upwardly away from each other and terminate in rounded ends 112 in sealing contact with the walls 32'', 31'', respectively. The rounded ends 112 assure an effective seal against the inner surfaces (unnumbered) of the walls 32'', 31''.

Generally parallel transverse motor mounting walls 121, 122 (See FIG. 9) project downwardly from the bottom wall 54'', span the distance between the longitudinal walls 54'' (and 55 not shown) and are integrally joined thereto during the in situ injection molding of the primary pan 13''. The transverse walls 121, 122 may also have reinforcing rods or members embedded therein, just as in the case of the rods or members 61, 62 of the primary pan 13. A generally inverted U-shaped bracket 123 functions as a reinforcement and includes a pair of countersunk openings 124 in a web 125 which is normal to a pair of parallel legs or arms 126, 127. The arms 126, 127 are conventionally connected by nuts and bolts 130 to the respective transverse walls 121, 122 after bolts 131 have been placed in the openings 124 with their threaded end portions (unnumbered) depending downwardly and normal to the bottom wall 52''. The bolts 131 have a square shoulder (not shown) between the head (unnumbered) and the threaded end portion thereof which mates with a square portion of the openings 124 to prevent the bolts 131 from rotating when nuts 132 are tightened to secure another inverted generally U-shaped bracket 135 to the web 123. The bracket 135 is of a conventional construction and supports therefrom in a conventional manner a fan motor 14''.

An advantage of the construction shown in FIGS. 8 and 9 is that the bottom wall 52'' has absolutely no openings therein, as, for example, the openings associated with the motor mounts 80 (FIG. 5) and, thus, the bolts and nuts 131, 132 cannot be adversely affected by leaking condensation. Furthermore, as viewed from below, the transverse motor mounting walls 121, 122 and the longitudinal walls 54'', 55'' are of a generally H-shaped configuration which imparts tremendous rigidity to the central portion of the overall primary pan 13''. This is highly desirable to reduce wear, tear and breakage, both relative to fasteners and pans, by continuous forces created by the torque of the motor 14'' as it is constantly cycled between its energized and deenergized states.

Figure 10:
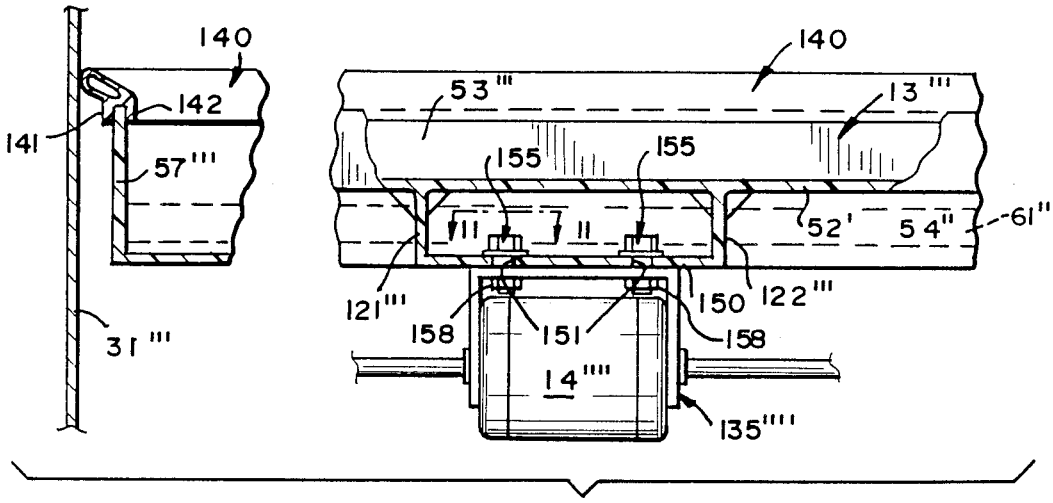
FIG. 10 is a fragmentary cross sectional view similar to FIG. 9 of another primary pan, and illustrates a bottom wall carrying an integral fan motor mounting and a separate peripheral flexible sealing flap carried by a peripheral wall of the primary pan.
Figure 11:
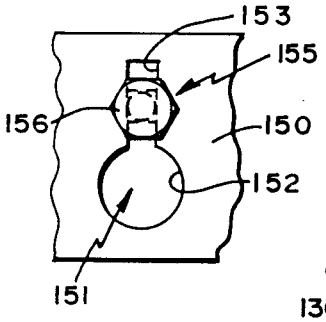
FIG. 11 is an enlarged fragmentary view taken along line 11—11 of FIG. 10, and illustrates one of a pair of key-hole slots and fasteners for adjustably securing the fan motor relative to the primary pan.

Another embodiment of the invention is illustrated in FIG. 10 of the drawings, and like elements corresponding to those heretofore described have been identified with like numerals, though being triple primed. A primary pan 13''' includes a peripheral wall 53''' which includes an end wall 57''', an opposite end wall (not shown) parallel thereto, a longitudinal wall 54''' and an opposite longitudinal wall parallel thereto. An upper peripheral edge (unnumbered) of the peripheral wall 53''' carries a peripheral sealing flap or lip 140 made of tubular ABS plastic material which has a pair of legs 141, 142 spanning and adhesively bonded to the upper peripheral edge (unnumbered) of the peripheral wall 53'''. In this case the peripheral sealing flap 140 not only seals against the vertical wall or support 31'' and the opposite unillustrated wall parallel thereto, but also seals against the front and rear walls or panels (not shown) of the associated fan cooling unit (not shown), as is most apparent from FIG. 1. Thus, the entire area of the fan unit housing (11 in FIG. 1, for example) above the primary pan 13''' (substituted for the primary pan 13 in FIG. 1) is sealed from the area therebelow. Therefore, air leakage about the entire periphery of the primary pan 13''' and the four peripheral walls contacted by the peripheral flap 140 is precluded. This assures high efficiency since the air flow path indicated by the dashed headed unnumbered arrows in FIG. 1 is assured. Obviously, in keeping with the present invention the separate peripheral flap 140 bounding the entire peripheral wall 53''' can be an integral peripheral flap, such as the end flaps 58, 59, molded in situ during the injection molding of the primary pan 13'''. Stated otherwise, the longitudinal walls 54, 55 of the primary pan 13 can also include flaps therealong projecting outwardly and upwardly therefrom corresponding to the flaps 58, 59. When a pan is in situ injection molded in this fashion and inserted in the housing 11 (FIG. 1), the peripheral flap now bounding the entirety of the peripheral wall 53 will not only seal against the vertical walls 31, 32, but will also seal against the rear wall (not shown) and the front wall 26. This effectively prevents/reduces air leakage between the exterior periphery of the primary pan 13 and the interior adjacent surfaces of the housing 11 and, thus, assures efficient air flow along the paths indicated by the dashed unnumbered headed arrows in FIG. 1.

The primary pan 13''' also includes depending transversely extending motor mounting walls 121''', 122''' which are in turn spanned by a wall 150 having at least two keyhole slots 151 each defined by a large generally circular opening 152 and an elongated opening 153 with, of course, the elongated openings 153 generally parallel to each other. A fastener 155, such as a bolt, having a head 156 smaller than the circular opening 152 can be inserted from below, as viewed in FIG. 8, and slid into the elongated slot portion 153 with a rectangular shoulder (unnumbered) of the bolt 155 corresponding to the size and configuration of the elongated slot portion 153 which prevents relative rotation therebetween. Nuts 158 are then threaded from below to secure a conventional inverted U shaped bracket 135'''' and its motor 14'''' to the wall 150. This construction offers the same rigidity as that heretofore described relative to FIGS. 8 and 9 and additionally allows the motor 14'''' to be shifted front-to-back and vice versa, as viewed in FIG. 10, to assure that the fans 15 (FIG. 1) and the housings 92 thereof are properly oriented and located relative to the openings 71, 72 (FIG. 5) of the primary pan 13''''.

Although a preferred embodiment of the invention has been specifically illustrated and described herein, it is to be understood that minor variations may be made without departing from the spirit and scope of the invention, as defined in the appended claims.

I claim:

1. A fan coil unit comprising a primary pan, means for defining an air passage in said primary pan, a condensation coil positioned generally above said pan, fan means for directing air from an area below said primary pan through said air passage and to an area above said primary pan, a gap between a lower edge portion of said condensation coil and said primary pan, and relatively thin flexible means for bridging and substantially closing said gap and generally preventing air from passing therethrough whereby air is essentially forced to travel from the area above said primary pan to and through said condensation coil resulting in the formation of condensation upon said condensation coil and its collection by said primary pan.

2. The fan coil unit as defined in claim 1 wherein said relatively thin flexible bridging means is impermeable synthetic polymeric sheet material.

3. The fan coil unit as defined in claim 1 wherein said relatively thin flexible bridging means is water impermeable synthetic polymeric sheet material.

4. The fan coil unit as defined in claim 1 wherein said relatively thin flexible bridging means is flaccid synthetic polymeric sheet material 5. The fan coil unit as defined in claim 1 wherein said relatively thin flexible bridging means is water impermeable synthetic polymeric flaccid sheet material.

6. The fan coil unit as defined in claim 1 wherein said relatively thin flexible bridging means is a folded sheet.

7. The fan coil unit as defined in claim 1 wherein said relatively thin flexible bridging means is a fan-folded sheet.

8. The fan coil unit as defined in claim 1 wherein said relatively thin flexible bridging means is a bellows.

9. The fan coil unit as defined in claim 1 wherein said relatively thin flexible bridging means is a water impermeable synthetic polymeric folded sheet.

10. The fan coil unit as defined in claim 1 wherein said relatively thin flexible bridging means is a water impermeable fan folded sheet.

11. The fan coil unit as defined in claim 1 wherein said relatively thin flexible bridging means is a water impermeable bellows.

12. The fan coil unit as defined in claim 1 including means for releasably securing said flexible bridging means to said primary pan.

13. The fan coil unit as defined in claim 1 including means for releasably securing said flexible bridging means to said condensation coil.

14. The fan coil unit as defined in claim 1 including means for releasably securing said flexible bridging means to said primary pan, and means for releasably securing said flexible bridging means to said condensation coil.

15. The fan coil unit as defined in claim 1 wherein said primary pan includes a generally elongated pan body, and a metal reinforcing rod bonded to at least one longitudinal edge of said elongated pan body.

16. The fan coil unit as defined in claim 1 wherein said primary pan includes a generally elongated pan body, and a metal reinforcing rod in situ molded to at least one longitudinal edge of said elongated pan body.

17. The fan coil unit as defined in claim 1 including means for defining a housing within which are located said primary pan, condensation coil and flexible bridging means; and sliding connection means for inserting and removing said primary pan relative to said housing means.

18. The fan coil unit as defined in claim 1 wherein said fan means includes a motor, means for supporting said motor beneath said primary pan, said primary pan having a bottom wall, said motor supporting means including at least one motor mount projecting from and above an upper surface of said bottom wall, a bore in said motor mount and bottom wall, a fastener in said bore and connected to said motor, and means sealing said bore and fastener from above.

19. The fan coil unit as defined in claim 1 wherein said fan means includes a motor, means for supporting said motor beneath said primary pan, said primary pan having a bottom wall, said motor supporting means including at least one motor mount projecting from and above an upper surface of said bottom wall, a bore in said motor mount and bottom wall, a fastener in said bore and connected to said motor, and gasket means sealing said bore and fastener from above.

20. The fan coil unit as defined in claim 1 wherein said fan means includes a motor, means for supporting said motor beneath said primary pan, said primary pan having a bottom wall, said motor supporting means including at least one motor mount projecting from and above an upper surface of said bottom wall, a bore in said motor mount and bottom wall, a fastener in said bore and connected to said motor, and silicone means sealing said bore and fastener from above.

21. The fan coil unit as defined in claim 1 wherein said condensation coil and primary pan are generally elongated and define therebetween a relatively elongated gap, and means at transverse ends of said primary pan for effecting pivotal connection to an associated housing whereby said primary pan can effect condensation drainage in either longitudinal direction and said gap remains bridged irrespective of the inclination, direction of inclination or lack of inclination of said primary pan.

22. The fan coil unit as defined in claim 8 wherein said fan means includes a motor, means for supporting said motor beneath said primary pan, said primary pan having a bottom wall, said motor supporting means including at least one motor mount projecting from and above an upper surface of said bottom wall, a bore in said motor mount and bottom wall, a bore in said motor mount and bottom wall, a fastener in said bore and connected to said motor, and means sealing said bore and fastener from above.

23. The fan coil unit as defined in claim 8 including means for releasably securing said flexible bridging means to said primary pan.

24. The fan coil unit as defined in claim 8 including means for releasably securing said flexible bridging means to said condensation coil.

25. The fan coil unit as defined in claim 8 including means for releasably securing said flexible bridging means to said primary pan, and means for releasably securing said flexible bridging means to said condensation coil.

26. The fan coil unit as defined in claim 8 including means for defining a housing within which are located said primary pan, condensation coil and flexible bridging means; and sliding connection means for inserting and removing said primary pan relative to said housing means.

27. The fan coil unit as defined in claim 9 wherein said fan means includes a motor, means for supporting said motor beneath said primary pan, said primary pan having a bottom wall, said motor supporting means including at least one motor mount projecting from and above an upper surface of said bottom wall, a bore in said motor mount and bottom wall, a bore in said motor mount and bottom wall, a fastener in said bore and connected to said motor, and means sealing said bore and fastener from above.

28. The fan coil unit as defined in claim 1 wherein said fan means includes a motor, means for supporting said motor beneath said primary pan, said primary pan having a bottom wall, said motor supporting means including at least one motor mount projecting from and above an upper surface of said bottom wall, a bore in said motor mount and bottom wall, and cap means for sealing said bore and fastener from above.

29. A fan coil unit comprising a primary pan, means for defining an air passage in said primary pan, a condensation coil positioned generally above said pan, fan means for directing air from an area below said primary pan through said air passage and to an area above said primary pan, a gap between a lower edge portion of said condensation coil and said primary pan, relatively thin flexible means for bridging said gap and generally preventing air from passing therethrough whereby air is essentially forced to travel from the area above said primary pan to and through said condensation coil resulting in the formation of condensation upon said condensation coil and its collection by said primary pan, and clip means for releasably clip-securing said flexible bridging means to said primary pan.

30. A fan coil unit comprising a primary pan, means for defining an air passage in said primary pan, a condensation coil positioned generally above said pan, fan means for directing air from an area below said primary pan through said air passage and to an area above said primary pan, a gap between a lower edge portion of said condensation coil and said primary pan, relatively thin flexible means for bridging said gap and generally preventing air from passing therethrough whereby air is essentially forced to travel from the area above said primary pan to and through said condensation coil resulting in the formation of condensation upon said condensation coil and its collection by said primary pan, and clip means for releasably clip-securing said flexible bridging means to said condensation coil.

31. A fan coil unit comprising a primary pan, means for defining an air passage in said primary pan, a condensation coil positioned generally above said pan, fan means for directing air from an area below said primary pan through said air passage and to an area above said primary pan, a gap between a lower edge portion of said condensation coil and said primary pan, relatively thin flexible means for bridging said gap and generally preventing air from passing therethrough whereby air is essentially forced to travel from the area above said primary pan to and through said condensation coil resulting in the formation of condensation upon said condensation coil and its collection by said primary pan, clip means for releasably clip-securing said flexible bridging means to said primary pan, and means for releasably clip-securing said flexible bridging means to said condensation coil.

32. A fan coil unit comprising a primary pan, means for defining an air passage in said primary pan, a condensation coil positioned generally above said pan, fan means for directing air from an area below said primary pan through said air passage and to an area above said primary pan, said fan means includes a motor, means for supporting said motor beneath said primary pan, said primary pan having a bottom wall, said motor supporting means including at least one motor mount projecting from and above an upper surface of said bottom wall, a bore in said motor mount and bottom wall, a fastener in said bore and connected to said motor, and means sealing said bore and fastener from above.

33. A fan coil unit comprising a primary pan, means for defining an air passage in said primary pan, a condensation coil positioned generally above said pan, fan means for directing air from an area below said primary pan through said air passage and to an area above said primary pan, said fan means includes a motor, means for supporting said motor beneath said primary pan, said primary pan having a bottom wall, said motor supporting means including at least one motor mount projecting from and above an upper surface of said bottom wall, a bore in said motor mount and bottom wall, a fastener in said bore and connected to said motor, and gasket means sealing said bore and fastener from above.

34. A fan coil unit comprising a primary pan, means for defining an air passage in said primary pan, a condensation coil positioned generally above said pan, fan means for directing air from an area below said primary pan through said air passage and to an area above said primary pan, said fan means includes a motor, means for supporting said motor beneath said primary pan, said primary pan having a bottom wall, said motor supporting means including at least one motor mount projecting from and above an upper surface of said bottom wall, a bore in said motor mount and bottom wall, a fastener in said bore and connected to said motor, and silicone means sealing said bore and fastener from above.

35. A fan coil unit comprising a primary pan, means for defining an air passage in said primary pan, a condensation coil positioned generally above said pan, fan means for directing air from an area below said primary pan through said air passage and to an area above said primary pan, said fan means includes a motor, means for supporting said motor beneath said primary pan, said primary pan having a bottom wall, said motor supporting means including at least one motor mount projecting from and above an upper surface of said bottom wall, a bore in said motor mount and bottom wall, a fastener in said bore and connected to said motor, and cap means sealing said bore and fastener from above.

* * * * *